US009233779B2

(12) United States Patent
Rossignol

(10) Patent No.: US 9,233,779 B2
(45) Date of Patent: Jan. 12, 2016

(54) POUCH HAVING A FLEXIBLE CASING DELIMITING A RESERVOIR WHEREIN A PRODUCT TO BE DISPENSED IS INTENDED TO BE CONDITIONED

(71) Applicant: ALBEA LACROST, Lacrost (FR)

(72) Inventor: Eric Rossignol, Chalon sur Saone (FR)

(73) Assignee: ALBEA LACROST, Lacrost (FR)

( * ) Notice: Subject to any disclaimer, the term of this patent is extended or adjusted under 35 U.S.C. 154(b) by 3 days.

(21) Appl. No.: 14/182,460

(22) Filed: Feb. 18, 2014

(65) Prior Publication Data

US 2014/0231454 A1 Aug. 21, 2014

(30) Foreign Application Priority Data

Feb. 20, 2013 (FR) ..... 13 51465

(51) Int. Cl.
*B65D 35/56* (2006.01)
*B65D 35/28* (2006.01)
(Continued)

(52) U.S. Cl.
CPC ..... *B65D 35/28* (2013.01); *A45D 34/04* (2013.01); *B05B 11/0043* (2013.01); *B05B 11/0054* (2013.01); *B05B 11/0056* (2013.01); *B05B 11/3032* (2013.01); *B65B 3/045* (2013.01); *B65B 31/047* (2013.01); *B65D 75/5883* (2013.01); *B67D 7/0294* (2013.01); *A45D 2034/005* (2013.01); *A45D 2200/056* (2013.01)

(58) Field of Classification Search
CPC ..... B65D 35/28; B65D 35/26; B65D 35/44; B65D 35/568; B65D 37/44; B65D 37/00; B65D 75/5822; B65D 75/5877; B67D 7/0284; B05B 11/0056; B05B 11/0043; B05B 11/3932; B05B 11/3032; B05B 11/3033; B05B 11/3043; B65B 3/045
USPC ..... 222/105, 106, 92–97, 206–216, 183, 222/173; 383/80, 93, 96
See application file for complete search history.

(56) References Cited

U.S. PATENT DOCUMENTS 5,911,340 A * 6/1999 Uematsu ..... 222/92
8,534,500 B2 * 9/2013 Baier et al. ..... 222/94
(Continued)

FOREIGN PATENT DOCUMENTS

WO 2009/096585 A1 8/2009
WO 2011/144840 A1 11/2011

OTHER PUBLICATIONS

French Patent Application 1351465, International Search Report, dated Aug. 14, 2013.

*Primary Examiner* — Lien Ngo
(74) *Attorney, Agent, or Firm* — Banner & Witcoff, Ltd.

(57) ABSTRACT

The invention relates to a pouch (6) having a flexible casing delimiting a reservoir wherein a product to be dispensed is intended to be conditions, said pouch being provided with a tip (19) comprising a base that has an exterior wall whereon is fixed in a sealed manner a mouth (21), said tip having a duct extending between a lower opening and an upper opening, the tip (19) also having a well that extends between an interior opening and a lateral opening coming out into the exterior wall by being covered in a sealed manner by the mouth (20), the upper opening opening to the exterior of the pouch (6), said tip being provided with a cap (26) which is arranged in order to be able to be mounted in said upper opening by closing in a sealed manner the communication between the reservoir and the exterior while still leaving open the communication between the reservoir and the well.

16 Claims, 7 Drawing Sheets

(51) Int. Cl.

| | |
|---|---|
| ***B05B 11/00*** | (2006.01) |
| ***B65D 75/58*** | (2006.01) |
| ***B67D 7/02*** | (2010.01) |
| ***B65B 3/04*** | (2006.01) |
| ***A45D 34/04*** | (2006.01) |
| ***B65B 31/04*** | (2006.01) |
| *A45D 34/00* | (2006.01) |

(56) References Cited

U.S. PATENT DOCUMENTS

| | | | | |
|---|---|---|---|---|
| 2004/0011820 | A1* | 1/2004 | Abergel et al. | 222/214 |
| 2006/0255068 | A1* | 11/2006 | Genosar | 222/207 |
| 2006/0266775 | A1 | 11/2006 | Niwa | |
| 2010/0084432 | A1* | 4/2010 | Pelfrey | 222/153.13 |
| 2010/0102085 | A1* | 4/2010 | Kanfer et al. | 222/94 |

* cited by examiner

POUCH HAVING A FLEXIBLE CASING DELIMITING A RESERVOIR WHEREIN A PRODUCT TO BE DISPENSED IS INTENDED TO BE CONDITIONED

CROSS REFERENCE TO RELATED APPLICATIONS

This application claims the benefit of French Patent Application No. FR-13 51465 filed Feb. 20, 2013, which is hereby incorporated herein by reference in its entirety.

The invention relates to a pouch having a flexible casing delimiting a reservoir wherein a product to be dispensed is intended to be conditioned, a method for conditioning a product in the reservoir of such a pouch, as well as a unit for dispensing a product comprising a case and such a pouch wherein the product to be dispensed is conditioned.

In particular, the product to be dispensed can be fluid, for example in the form of a liquid, cream or paste, in particular for cosmetic or pharmaceutical use, or be in the form of a loose or compact powder.

It is known, in particular through document WO-2011/144840, a unit wherein a flexible pouch of product is arranged in a housing formed in a case, in particular in order to protect said pouch and/or to provide it with advantageous aesthetics. In particular, the case has a window wherein a dispensing zone can be accessed in order to be able to actuate the dispensing, in particular by manual pressing.

The dispensing can be carried out by the intermediary of a pump that has a pumping chamber provided with a dispensing opening, the actuating of said pump being carried out by flexible manual deformation of said pumping chamber. In particular, the dispensing zone can have a substantial extended surface allowing for the sliding of a finger along said zone in order to actuate the dispensing.

In order to benefit from a unit that can be refilled satisfactorily, it is desirable that the pouch be arranged reversibly in the housing of the case. In effect, once the pouch is empty, it is then possible to replace it with a full one without having to change the case.

Document WO-2011/144840 provides to provide the pouch with a tip comprising a base which has an exterior wall whereon is fixed is a sealed manner a mouth of the casing, said tip having a duct that passes through the base by extending between a lower opening arranged in the reservoir and an upper opening which is blind.

In order to allow for the putting into communication of the reservoir with the dispensing pump, the tip also has a well that extends in the base between an interior opening coming out into the duct and a lateral opening coming out into the exterior wall.

As such, by providing that the lateral opening is covered in a sealed manner by the mouth, it is possible successively:

- to hermetically condition the product in the pouch in order to prevent any risk of leakage and/or contamination of the product; then
- by providing a dispensing device provided with a nipple for perforating the mouth, for placing said reservoir in communication with said device by mounting said nipple in the well.

However, the pouch proposed by prior art does not entirely provide satisfaction in carrying out the conditioning of the product in the reservoir. In particular, the introduction of the product into the reservoir through the mouth and the fixing of the tip in said mouth are restrictive to implement successively on an industrial level. Furthermore, in order to condition the product in the pouch without conditioning the air, it is necessary to arrange the pouch in a vacuum bell jar in order to empty the air from the reservoir prior to its filling.

The invention aims to improve prior art by proposing in particular a pouch provided with a tip making it possible to condition the product in the reservoir in a simplified manner, in particular without conditioning air, said tip allowing for the later placing into communication of the reservoir with a device for dispensing the conditioned product.

To this effect, according to a first aspect, the invention proposes a pouch having a flexible casing delimiting a reservoir wherein a product to be dispensed is intended to be conditioned, said pouch being provided with a tip comprising a base that has an exterior wall whereon is fixed in a sealed manner a mouth of the casing, said tip having a duct that passes through the base by extending between a lower opening arranged in the reservoir and an upper opening, the tip also having a well that extends in the base between an interior opening coming out into the duct and a lateral opening coming out into the exterior wall of the base by being covered in a sealed manner by the mouth, with the upper opening of the duct opening to the exterior of the pouch, said tip being provided with a cap which is arranged to be able to be mounted in said upper opening by closing in a sealed manner the communication between the reservoir and the exterior by the intermediary of said upper opening while still leaving open the communication between the reservoir and the well by the intermediary of the lower opening of said duct.

In particular, the cap is mounted on the upper opening of the duct by being able to be displaced between a high position wherein the communication between the reservoir and the exterior is open and a low position for the sealed closing of the upper opening.

According to a second aspect, the invention proposes a method for conditioning a product in the reservoir of such a pouch, said method providing to connect in a sealed manner a nozzle on the upper opening of the duct with the cap in high position, said nozzle successively aspirating the air of the reservoir and injecting the product into said reservoir by the intermediary of the duct, said method then providing to, before the disconnection of the nozzle, to displace the cap into low position in order to close the reservoir in a sealed manner.

According to a third aspect, the invention proposes a unit for dispensing a product conditioned in the reservoir of such a pouch wherein the cap is mounted in the upper opening of the duct by closing the reservoir in a sealed manner, said unit comprising a case having a housing wherein the pouch is intended to be arranged, said unit comprising a device for dispensing the conditioned product which comprises a nipple intended to be introduced into the well in order to place said dispensing device in communication with the reservoir by the intermediary of said well, said nipple being arranged to allow for the perforation of the mouth when it is introduced into the well.

Other objects and advantages of the invention shall appear in the following description, given in reference to the annexed figures, wherein.

Figure 1:
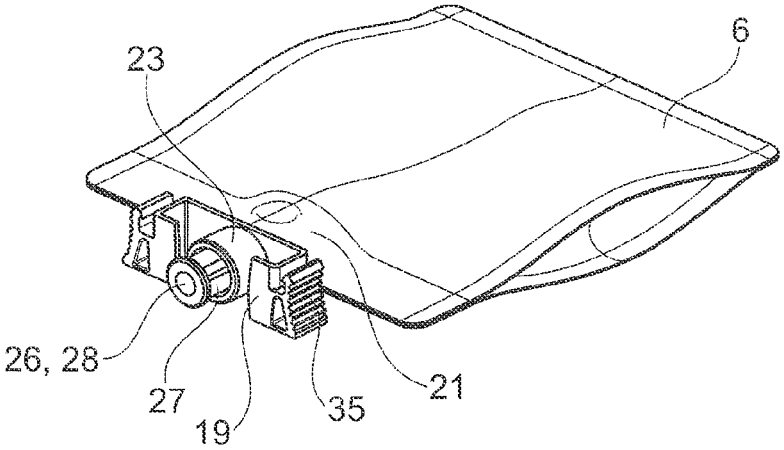
FIG. 1 is a perspective view of a pouch according to an embodiment of the invention.
Figure 2A:
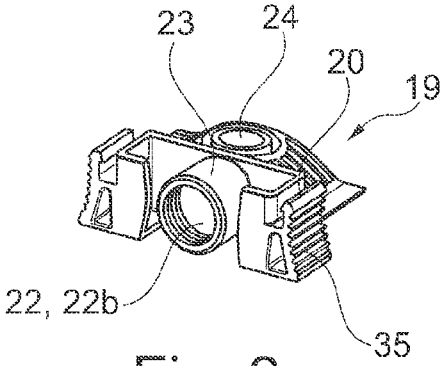
FIG. 2 are view of the tip of FIG. 1 without the cap, respectively as a front perspective (FIG. 2*a*), rear perspective (FIG. 2*b*) and as a longitudinal cross-section (FIG. 2*c*)
Figure 2B:
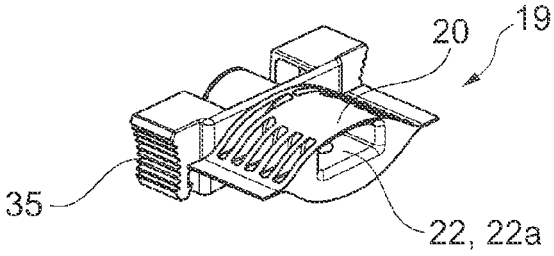
Figure 2C:
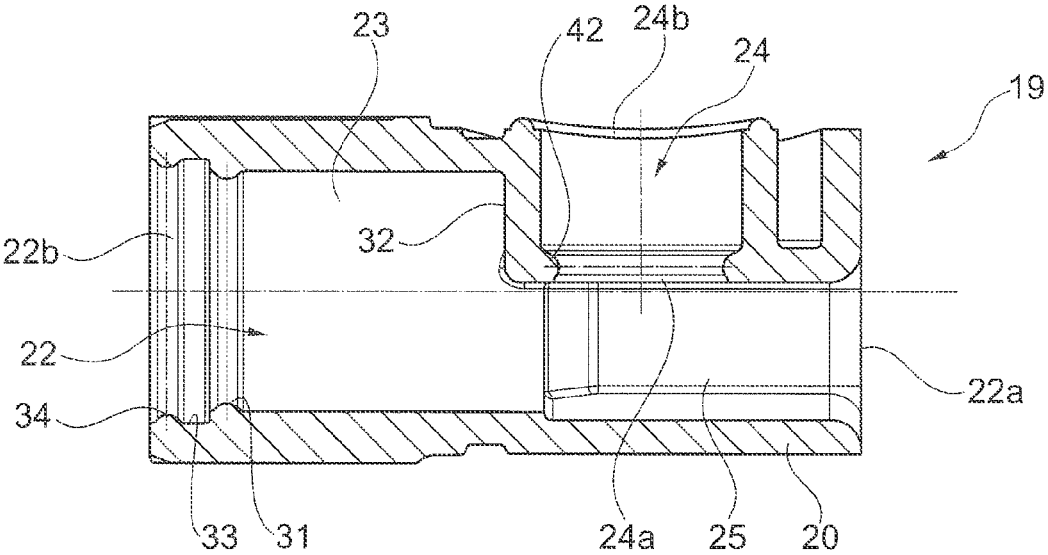
Figure 6:
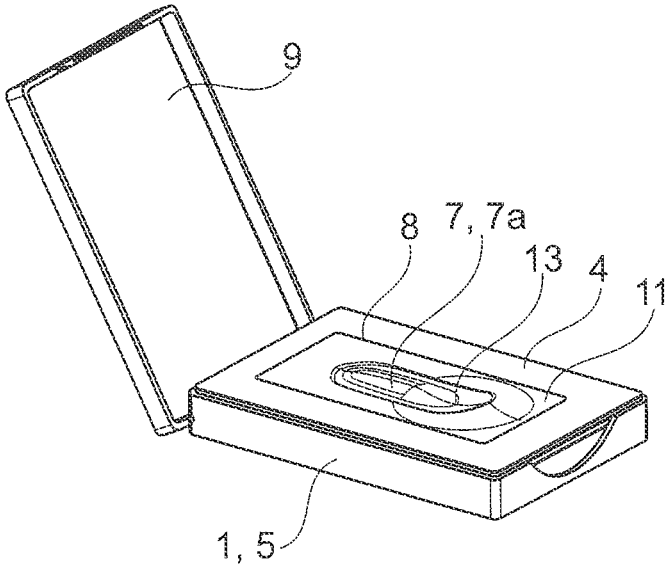
Figure 7:
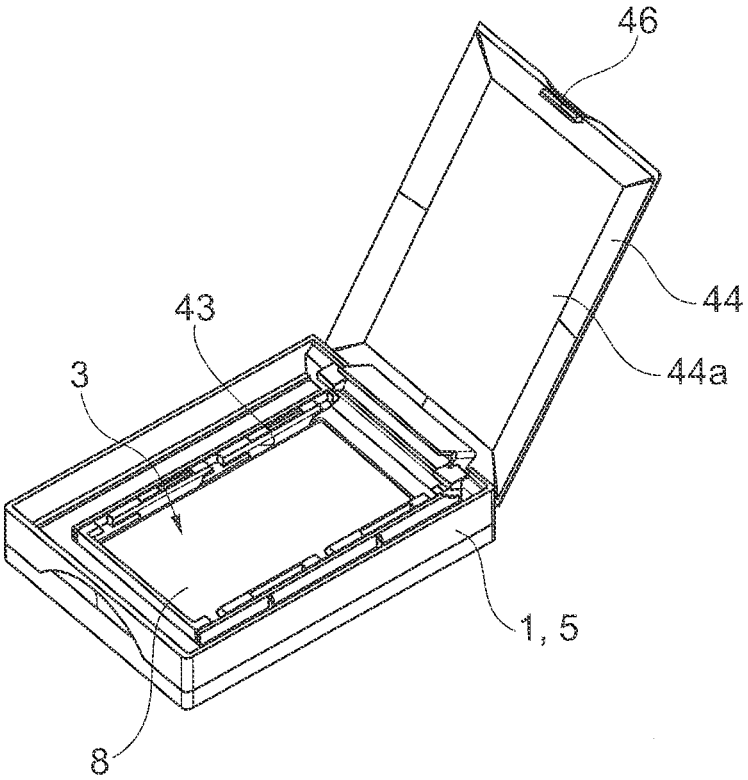
Figure 8A:
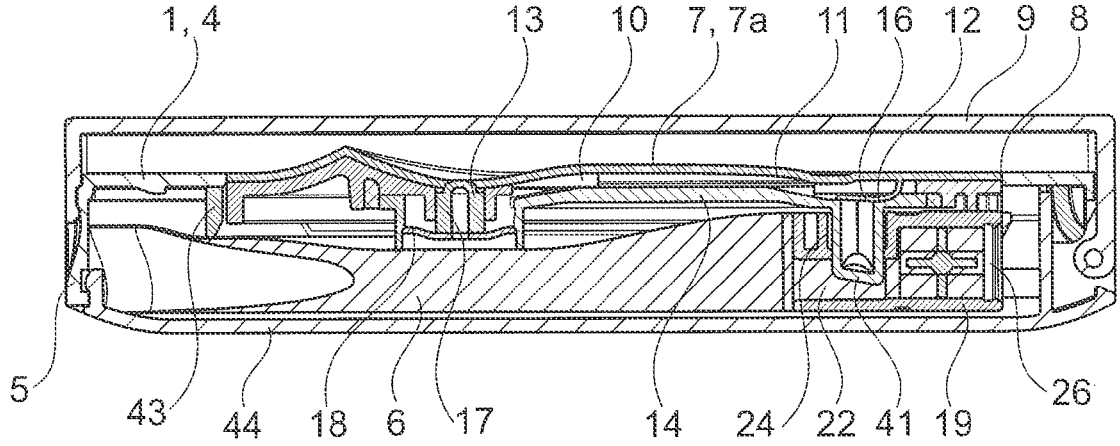
Figure 8B:
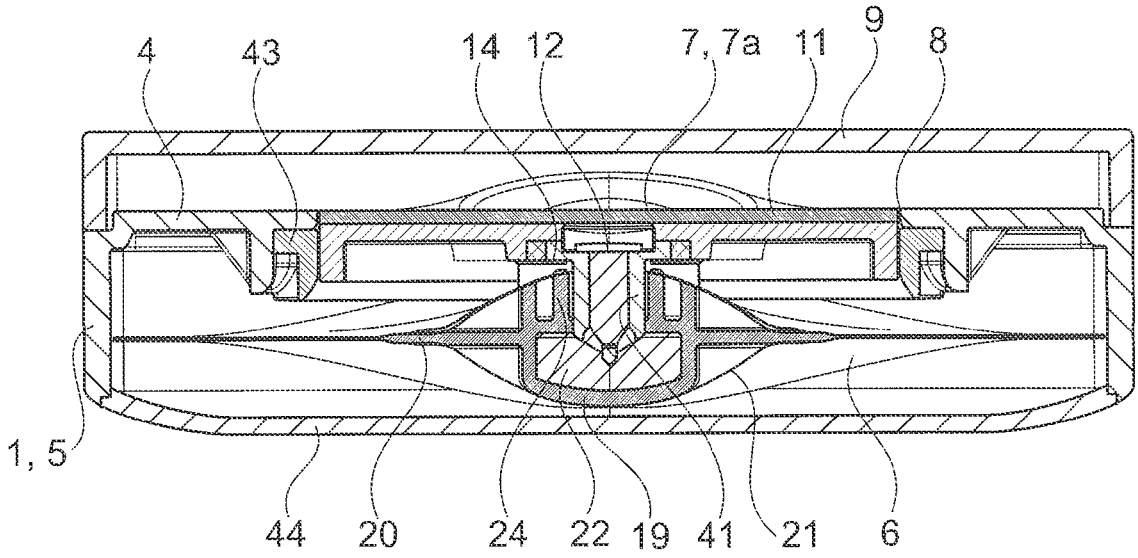
Figure 9:
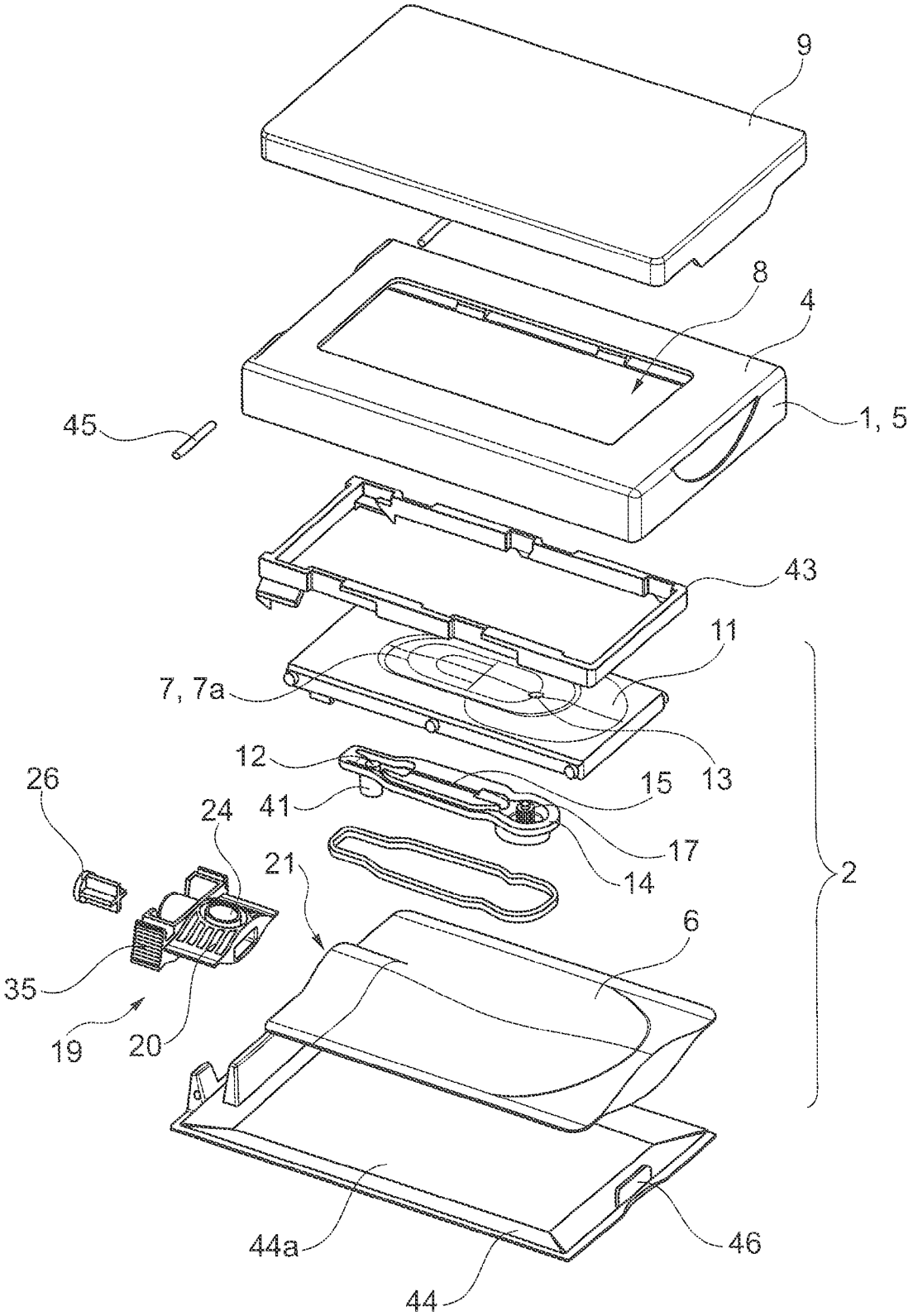

FIGS. 5*a* to 5*j* diagrammatically show the successive steps of a method for conditioning a product in a pouch according to FIG. 1;

FIG. 6 is a top view in perspective of a unit for dispensing according to an embodiment of the invention, said unit being shown mounted and with the cover open;

FIG. 7 is a bottom view in perspective of the unit for dispensing of FIG. 1, said unit being shown with the base in open position and without the pouch;

FIG. 8 show respectively a longitudinal cross-section (FIG. 8*a*) and a transverse cross-section (FIG. 8*b*) of the unit for dispensing according to FIG. 6;

FIG. 9 shows an exploded view of the various components of the unit for dispensing according to FIG. 6.

A unit intended to contain a fluid product for the purposes of dispensing it is described hereinbelow. In particular examples, the product can be in the form of a liquid, cream or paste, in particular for cosmetic or pharmaceutical use, or be in the form of a loose or compact powder.

The unit for dispensing comprises a case 1 and a cassette 2 having a reservoir wherein the product to be dispensed is conditioned. The unit is intended to be mounted by arranging the cassette 2 in a housing 3 formed in a body of the case 1. In particular, the assembly of the cassette 2 can be reversed in order to benefit from a refillable unit by replacing an empty cassette 2 with a full one without having to change the case 1.

The case 1 can be made of a rigid material, for example plastic or metal material, by having in particular a relatively flat shape with oval, round, square or rectangular geometry, as can be commonly found in the make-up market. According to an embodiment, the case 1 can be mounted in a covering in order to improve its aesthetics. In the embodiment shown, the case 1 has an upper rectangular horizontal wall 4 under which extends a vertical peripheral wall 5 that laterally delimits the housing 3 on its four sides.

The cassette 2 comprises a pouch 6 wherein the product to be dispensed is conditioned in a sealed manner and a device for dispensing a product conditioned by the intermediary of a dispensing zone 7. In particular, the pouch 6 has a flexible casing, in particular with a polyolefin base, delimiting the conditioning reservoir of the product, with the flexibility of said pouch making it possible to maximise the capacity of the cassette 2 by allowing for its optimal adaptation to the volume of the housing 3.

In order to allow the user access to the dispensing zone 7 of the cassette 2, the upper wall 4 of the case 1 has a window 8 wherein said dispensing zone is arranged. In particular, the dispensing zone 7 and the window 8 are of substantial size in relation to that of the upper wall 4, in particular an upper surface 50% and even exceeding 70% of said surface of said upper wall, in order to benefit from a dispensing zone 7 that is accessible and extended. The dispensing zone 7 and the access window 8 can have identical geometry, in particular a similar size in order to be able to arrange said dispensing zone in a tight manner in said window. As such, the upper wall 4 and therefore the housing 3 are closed in the upper portion by the intermediary of the dispensing zone 7. In particular, the dispensing zone 7 is relatively flat and is flush against the upper wall 4 through the access window 8.

In the embodiment shown, the access window 8 has a rectangular geometry which is homothetic with that of the upper wall 4. The upper wall 4 has an edge that interiorly delimits the contour of the window 8, with said edge being connected exteriorly to the peripheral wall 5.

The case 1 comprises a cover 9 which is arranged to cover the dispensing zone 7 between two uses. In particular, the cover 9 can be articulated in rotation on a side of the peripheral wall 5 between an open access position to the dispensing zone 7 and a closed protective position of said zone between two uses. Furthermore, the cover 9 can be provided with a vanity mirror.

The device for dispensing shown comprises a pump having a pumping chamber 10 which is flexibly deformable by manual pressing on the dispensing zone 7. More precisely, the dispensing zone 7 has a flexibly deformable wall 11 that delimits the pumping chamber 10, said wall able to be made from material of the polyolefin type with shape memory or from an elastomeric material.

Advantageously in relation to the gestures for using the unit, the dispensing zone 7 comprises an upper pressing zone 7*a* having an extended geometry that is bordered on either side by a supply opening 12 of the pumping chamber 10 and by a dispensing opening 13 of the product in such a way as to allow a translation of the press exerted on the pumping chamber 10 from the vicinity of said supply opening in the direction of said dispensing opening. Furthermore, it can be provided that the dispensing opening 13 is formed in the extension of the pressing zone 7*a* in such a way, in the continuity of the actuating gesture of the pumping chamber 10, as to collect the product on the finger.

In the embodiment shown, the flexibly deformable wall 11 is provided with the dispensing opening 13, the pumping chamber 10 being formed between said wall and a reinforcement 14 arranged on the pouch 6. In particular, the reinforcement 14 is arranged between the pouch 6 and the flexibly deformable wall 11, said reinforcement able to be carried out by moulding a rigid plastic material.

The reinforcement 14 has the opening 12 for the supply with product of the pumping chamber 10. Moreover, the dispensing 13 and supply 12 openings are provided with a valve respectively for the output and input which are arranged in order to allow, by deformation of the pumping chamber 10, for the dispensing of the product by the dispensing opening 13 and, via flexible return, the supply of the pumping chamber 10 by the supply opening 12.

In particular, the deformation of the pumping chamber 10 induces a pressurising of the product contained in said chamber, with said pressure causing the closing of the input valve and the opening of the output valve, with the aspiration induced by the flexible return of the pumping chamber 10 in the non-deformed state causing the opening of the input valve and the closing of the output valve.

In the embodiment shown, the pressing on the flexibly deformable wall 11 is carried out in particular vertically in order displace said wall in contact on the reinforcement 14. Furthermore, a press of the finger on the upstream end of the pressing zone 7*a*, i.e. the zone in the vicinity of the supply opening 12, causes the closing of the input valve, then a translation of the pressing exerted on the pumping chamber 10 in the direction of the dispensing opening 13 causes the opening of the output valve and the emptying of the pumping chamber 10. In particular, this embodiment is favoured when the reinforcement 14 has a guiding imprint 15, in particular made as a hollow by having a width substantially equal to that of a finger, said imprint being arranged across from the pressing zone 7*a*. Indeed, the seal of the pressing of the wall 11 on the imprint 15 is as such favoured in such a way as to facilitate the emptying of the pumping chamber 10 during the translation. Furthermore, in order to prevent a pressing of the finger on the valves, the supply 12 and dispensing 13 openings are arranged to the exterior of the imprint 15.

Advantageously, the dispensing device allows for the pumping without air intake of the conditioned product, i.e., during dispensing, air does not enter into the reservoir of the pouch 6 as compensation for the dispensed product, and the flexibility of the casing allows for a reduction in the conditioning volume as the product is dispensed.

In the embodiment shown, the input valve is formed from a flexible lip 16 which is arranged to be thrust against the supply opening 12 during the deformation of the pumping chamber 10. In particular, the lip 16 is integrated under the flexibly deformable wall 11, said lip being inclined towards the pumping chamber 10 pressing on the supply opening 12. The lip 16 has an upper thrusting surface by pressurising the product in the pumping chamber 10 and can be raised from the supply opening 12 by aspiration of the product conditioned in the pouch 6.

Moreover, the output valve comprises a sealing punch 17 of the dispensing opening 13, said punch able to be reversibly displaced during the deformation of the pumping chamber 10. In particular, the reinforcement 14 has a surface wherein the punch 17 is mounted in sealed translation by the intermediary of a flexible collar 18 in such a way that the pressure exerted on said collar by the product coming from the pumping chamber 10 induces the reversible displacement of said punch outside of the dispensing opening 13.

The pouch 6 is provided with a tip 19, for example carried out by moulding a plastic material, comprising a base 20 that has an exterior wall whereon is fixed in a sealed manner, in particular by welding, a mouth 21 of the casing. More precisely, the exterior wall of the base 20 has an upper surface and a striated and curved lower surface, with the mouth 21 being formed between an upper edge and a lower edge of the casing, said edges covering and being fixed on respectively one of said surfaces.

The tip 19 has a duct 22 that passes through the base 20 by extending between a lower opening 22*a* arranged in the reservoir and an upper opening 22*b*. In the embodiment shown, the duct 22 has an upper portion 23 which is protruding from the base 20 so that the upper opening 22*b* opens to the exterior of the pouch 6, with the lower opening 22*a* being arranged under the base 20. In particular, the duct 22 therefore makes possible the communication between the exterior of the pouch 6 and the reservoir.

The tip 19 also has a well 24 that extends in the base 20 between an interior opening 24*a* coming out into the duct 22 and a lateral opening 24*b* coming out into the upper surface of the exterior wall of the base 20 by being covered in a sealed manner by the upper edge of the mouth 21. In particular, the lateral opening 24*b* is formed in the bowed central portion of the upper surface of the base 20.

In the embodiment shown, the connection between the duct 22 and the well 24 is in the shape of a T, with the upper 23 and lower 25 portions of the duct 22 extending horizontally on either side of the well 24 that extends vertically. In particular, the well 24 opens into the duct 22 in order to be in communication with the reservoir by the intermediary of the lower portion 25 of the duct 22.

The tip 19 is provided with a cap 26 which is arranged in order to be able to be mounted in the upper opening 22*b* by closing in a sealed manner the communication between the reservoir and the exterior by the intermediary of said upper opening while still leaving open the communication between the reservoir and the well 24 by the intermediary of the lower opening 22*a* of the duct.

As such, before the assembly of the unit for dispensing, the product can be introduced into the pouch 6 by the intermediary of the duct 22, the cap 26 being mounted in the upper opening 22*b* after the filling in order to hermetically seal the reservoir.

In particular, after conditioning, the seal of the reservoir is carried out on the one hand, by the cap 26 and, on the other hand due to the covering of the lateral opening 24*b* of the well 24 by the mouth 21. As such, the product can be easily conditioned in the pouch 6, said pouch can then be hermetically sealed so that it can be stored and transported before providing it with the device for dispensing.

Figure 3:
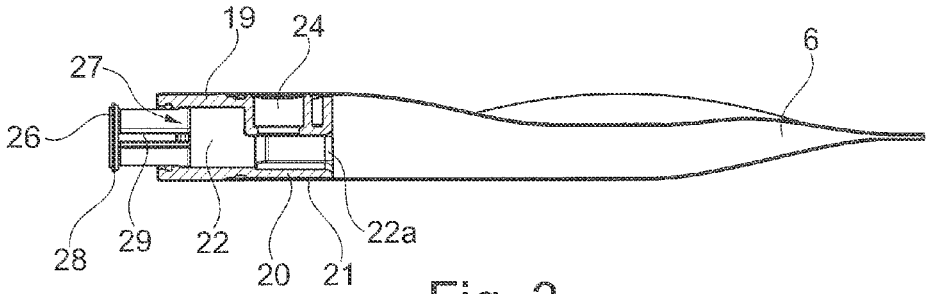
FIG. 3 shows a longitudinal cross-section of the pouch according to FIG. 1 wherein the cap is in high open position, with FIG. 3*a* being an enlarged view showing more particularly the assembly of the cap.
Figure 3A:
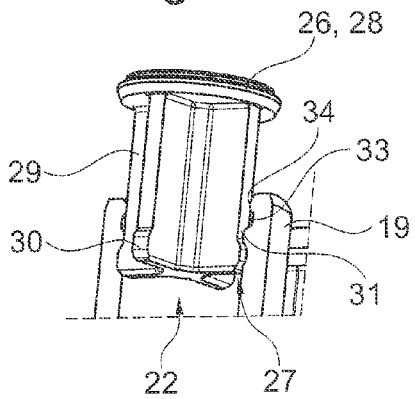
Figure 4:
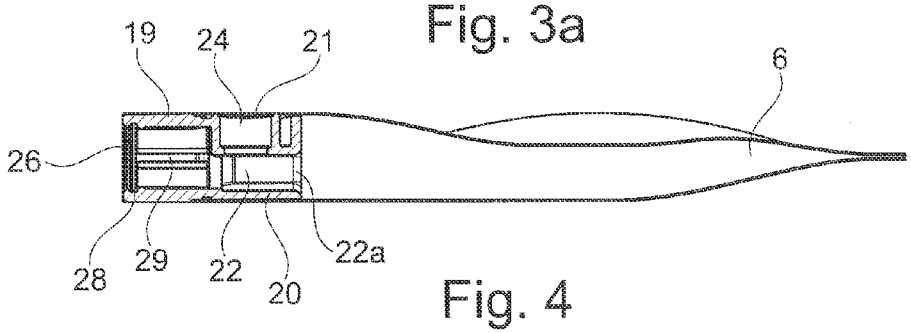
FIG. 4 shows a longitudinal cross-section of the pouch according to FIG. 1 wherein the cap is in low closed position, with FIG. 4*a* being an enlarged view showing more particularly the assembly of the cap.
Figure 4A:
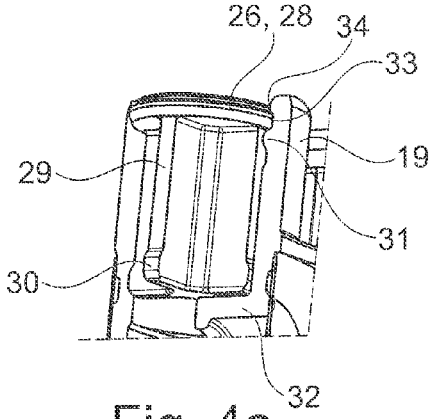

In the embodiment shown, the cap 26 is mounted in the upper opening 22*b* able to be displaced between a high position (FIG. 3) wherein the communication between the reservoir and the exterior is open and a low sealed closed position (FIG. 4) of the upper opening 22*b*.

Advantageously, the cap 26 is mounted slidingly in the upper portion 23 of the duct 22, said cap having:

- a lower surface that, in high position, is mounted in the upper portion 23 by forming passages 27 for communication between said surface and said portion; and
- a head 28 that, in low position, is engaged in a sealed manner in the upper opening 22*b*.

The cap 26 shown comprises a disc forming the head 28, under which extend four partitions 29 arranged as a cross, with the lower end of said partitions forming the lower surface by being mounted slidingly in the upper portion 23. Moreover, the lower ends of the partitions 29 are provided with a protrusion forming a lower ring 30 which is mounted as interference in the upper portion 23 in order to maintain the cap 26 in high position.

In particular, the ring 30 is discontinuous in order to form the passages 27 for communication between the cap 26 in high position and the duct 22. Moreover, in order to secure the maintaining of the cap 26 on the duct 22, the upper opening 22*b* has an interior bead 31 under which the lower ring 30 is mounted slidingly in the upper portion 23.

In the embodiment shown, the well 24 is formed inside a peripheral wall 32 that extends at least partially in the duct 22, said peripheral wall forming a travel stop of the sliding of the cap 26 in the upper portion 23. As such, it is provided that the cap 26, in low position, leaves the communication between the reservoir and the well 24 open by the intermediary of the lower opening 22*a* of the duct 22. In particular, the well 24 opens laterally into the lower portion 25 by decreasing the section of passage of the duct 22.

Moreover, the seal of the closing of the duct 22 by the cap 26 in low position can be made reliable by providing the upper opening 22*b* with an interior groove 33 wherein the head 28 in low position is engaged in a sealed manner. In the figures, the groove 33 is bordered at the bottom by the bead 31 and has an input contraction 34 in order to render reliable the sealed snap-fitting of the head 28 in said groove.

Advantageously, the tip 19 has two lugs 35 arranged on either side of the upper portion 23 of the duct 22, said lugs extending inside the mouth 21 in order to form means for manually grasping the pouch 6 in order to facilitate its assembly/withdrawal from the housing 3. In particular, the lugs 35 are arranged to allow them to be pinched between two fingers so as to be able to guide the pouch 6 in the housing 3 by arranging the dispensing zone 7 in the window 8.

In relation with the FIG. 5, a method for conditioning a product in the reservoir of the pouch 6 is described hereinbelow by means of a machine having a nozzle 36 that integrates in particular two pistons 37, 38, a product inlet 39 and an air outlet 40, said machine able to carry out the conditioning at high speed.

Figures 5A, 5B, 5C, 5D, 5E:
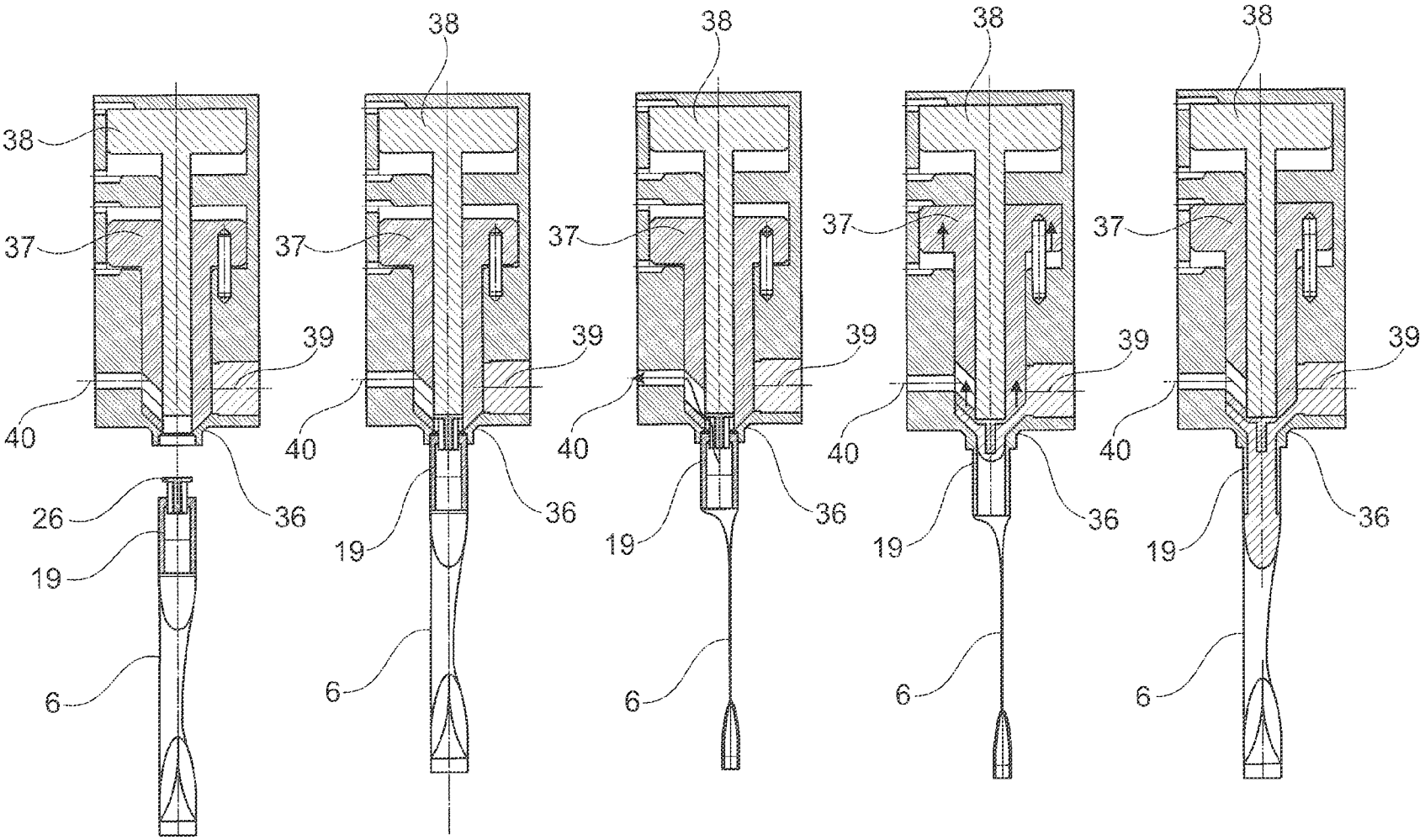

The method provides to have the upper opening 22*b* of the duct 22 with the cap 26 in high position (FIG. 5*a*) then to connect in a sealed manner the nozzle 36 on said upper opening (FIG. 5*b*). Then, the air outlet 40 of the nozzle 36 makes it possible to aspirate the air of the reservoir by the intermediary of the duct 22 (FIG. 5*c*) in order to be able to condition the product in said reservoir without conditioning the air with it.

Figures 5F, 5G, 5H, 5I, 5J:
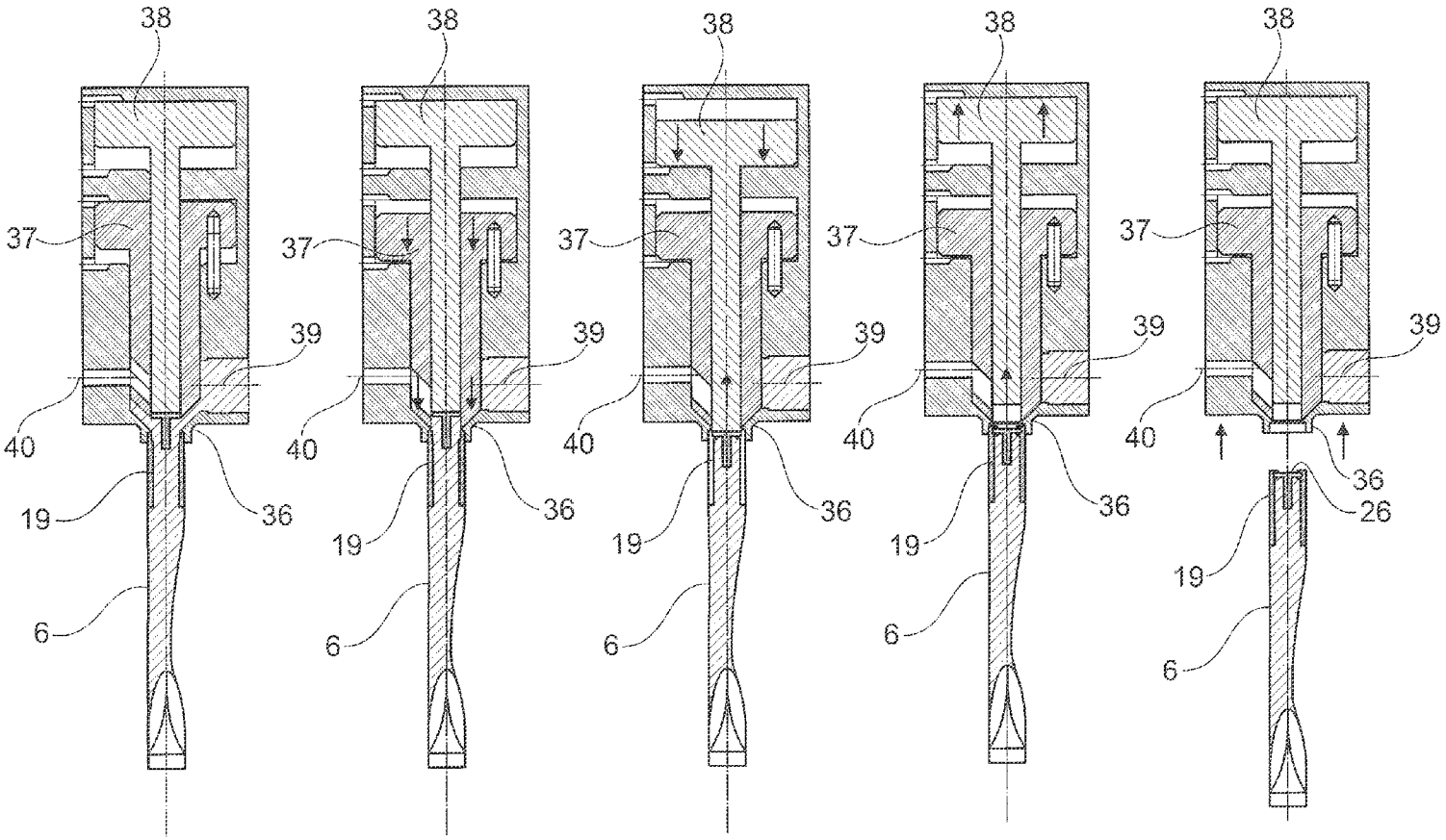

Once the reservoir is emptied of air, a piston 37 is actuated in order to open the product inlet 39 (FIG. 5*d*) then the product is injected into the reservoir by the intermediary of the passages 27 formed between the duct 22 and the cap 26 in high position (FIG. 5*e*) until it is filled (FIG. 5*f*). The piston 37 is then actuated in order to close the product inlet 39 (FIG. 5*g*).

The method provides, before the disconnection of the nozzle 36, to displace the cap 26 into low position in order to close the reservoir in a sealed manner. To do this, the other piston 38 is actuated in order to press on the head 28 of the cap 26 in order to displace into low position at the end of filling (FIG. 5*h*) then raise back into inactive position (FIG. 5*i*) before withdrawal of the nozzle 36 in order to disconnect the duct 22 (FIG. 5*j*).

A pouch 6 is thus obtained wherein the product to be dispensed is conditioned hermetically by the intermediary of the cap 26 mounted in low position in the upper opening 22*b* by closing the reservoir in a sealed manner. Moreover, the covering of the well 24 by the mouth 21 guarantees the seal, said well allowing for the later putting into communication of the conditioned product with its dispensing device.

To do this, the dispensing device comprises a nipple 41 which is intended to be introduced into the well 24 in order to place said dispensing device into communication with the reservoir by the intermediary of said well, said nipple being arranged in order to allow for the perforation of the mouth 21 when it is introduced into the well 24.

In the embodiment shown, the reinforcement 14 comprises, moulded in a single part, the nipple 41 which is intended to be introduced into the well 24 in order to place the supply opening 12 in sealed communication with the product conditioned in the pouch 6. In the embodiment shown, the nipple 41 has a bore forming the supply opening 12 of the pumping chamber 10, with the periphery of said nipple being dimensioned to be fitted into the well 24 which has an interior sealing bead 42.

In particular, the nipple 41 can have a chisel tip that allows the casing to be perforated. As such, after assembly of the dispensing device on the pouch 6, the cassette 2 integrating the dispensing zone 7 of said device can be mounted in the housing 3 of the case 1, possibly as a refill. Alternatively, the pouch 6 can be mounted in the housing 3 of a case 1 provided with the dispensing device, with the perforation of the casing then being carried out after assembly of the pouch 6 in its housing 3.

Advantageously, the unit for dispensing comprises a reversible locking mechanism of the cassette 2 mounted in the housing 3 with the dispensing zone 7 in the window 8. In particular, the mechanism allows for the easy assembly/disassembly of the cassette 2 as well as a particularly reliable locking of the position of said cassette in the housing 3, in particular with regards to pressings that have to be carried out on the dispensing zone 7.

To do this, the locking mechanism has a frame 43 which is mounted in horizontal translation in the housing 3 by being maintained vertically, said frame and the cassette 2 being provided with complementary means which are arranged to, in a first position of the frame 43, allow for the arranging of the cassette 2 in the housing 3 with the dispensing zone 7 in the window 8 and, in a second position of said frame, lock the position of the cassette 2 in the housing 3.

In particular, the assembly of the cassette 2 can be carried out by displacing it vertically in the housing 3 by arranging the dispensing zone 7 in the access window 8, with the later displacement of the frame 43 in its second position making it possible to lock the position of the cassette 2 without displacing it in order to prevent affecting the arrangement of said actuating zone in said window.

The case 1 shown comprises a base 44 which is articulated in rotation by the intermediary of axes 45 on a side of the peripheral wall 5 of the body of the case 1, in particular on the same side as that of the articulation of the cover 9, between an open access position to the housing 3 and a closed position wherein said base forms a lower wall of said housing. As such, in closed position which corresponds to the state of use of the unit, the housing 3 and therefore the cassette 2 are insulated from the exterior in order to reconcile protection and aesthetics.

To do this, the base 44 has a lower wall 44*a* with geometry similar to that of the upper wall 4 of the body of the case 1, said lower wall having two lateral edges, with one of said edges being articulated to the body and the other being provided with a locking prong 46 of said base in closed position.

Advantageously in relation to the refill gesture, the locking mechanism has a device for displacing the frame 43 which comprises complementary means provided on said frame and the base 44, said complementary means being arranged so that the closing of the base 44 induces the displacement of the frame 43 from its first to its second position. As such, the arrangement of the base 44 in open position allows for the assembly of the cassette 2 in the housing 3, the locking of the mounted cassette 2 being carried out by simple closure of the base 44.

The device for displacing the frame 43 can further include complementary means which are arranged so that the opening of the base 44 induces the displacement of the frame 43 from its second to its first position. As such, the unlocking of the cassette 2 so that it can be replaced is carried out by simple opening of the base 44.

The invention claimed is:

1. Pouch having a flexible casing delimiting a reservoir wherein a product to be dispensed is intended to be conditioned, said pouch being provided with a tip comprising a base that has an exterior wall whereon is fixed in a sealed manner a mouth of the casing, said tip having a duct that passes through the base by extending between a lower opening arranged in the reservoir and an upper opening, the tip also having a well that extends in the base between an interior opening coming out into the duct and a lateral opening coming out into the exterior wall of the base by being covered in a sealed manner by the mouth, said pouch being characterised in that the upper opening of the duct opens to the exterior of the pouch, said tip being provided with a cap which is arranged in order to be able to be mounted in said upper opening by closing in a sealed manner the communication between the reservoir and the exterior by the intermediary of said upper opening while still leaving the communication open between the reservoir and the well by the intermediary of the lower opening of said duct.

2. Pouch according to claim 1, characterised in that the cap is mounted on the upper opening of the duct by being able to be displaced between a high position wherein the communication between the reservoir and the exterior is open and a low sealed closed position of the upper opening.

3. Pouch according to claim 2, characterised in that the cap is mounted slidingly in an upper portion of the duct.

4. Pouch according to claim 3, characterised in that the well is formed inside a peripheral wall that extends at least partially in the duct, said peripheral wall forming a travel stop of the sliding of the cap in the upper portion.

5. Pouch according to claim 3, characterised in that the cap has a lower surface that, in high position, is mounted in the upper portion by forming passages for communication between said surface and said portion.

6. Pouch according to claim 5, characterised in that the lower surface of the cap has a lower ring which is mounted as interference in the upper portion in order to maintain said cap in high position, said ring being discontinuous in order to form the passages for communication.

7. Pouch according to claim 6, characterised in that the upper opening has an interior bead under which the lower ring is mounted slidingly in the upper portion.

8. Pouch according to claim 2, characterised in that the cap has a head that, in low position, is engaged in a sealed manner in the upper opening.

9. Pouch according to claim 8, characterised in that the upper opening has an interior groove, with the headin low position being engaged in a sealed manner in said groove.

10. Pouch according to claim 1, characterised in that the tip has two lugs arranged on either side of the duct, said lugs extending outside of the mouth in order to form means for manually grasping the pouch.

11. Method for conditioning a product in the reservoir of a pouch according to claim 2, said method providing to connect in a sealed manner a nozzle on the upper opening of the duct with the cap in high position, said nozzle successively aspirating the air from the reservoir and injecting product into said reservoir by the intermediary of the duct, said method then providing, before disconnection of the nozzle, to displace the cap in low position in order to close the reservoir in a sealed manner.

12. Method for conditioning according to claim 11, characterised in that the nozzle integrates a piston which comes to press on the cap in order to displace it into low position at the end of filling.

13. Unit for dispensing a product conditioned in the reservoir of a pouch according to claim 1 wherein the cap is mounted in the upper opening of the duct by closing the reservoir in a sealed manner, said unit comprising a case having a housing wherein the pouch is intended to be arranged, said unit comprising a device for dispensing the conditioned product that comprises a nipple intended to be introduced into the well in order to place said dispensing device into communication with the reservoir by the intermediary of said well, said nipple being arranged to allow for the perforation of the mouth when it is introduced into the well.

14. Unit for dispensing according to claim 13, characterised in that the device for dispensing comprises a pump that has a pumping chamber which is flexibly deformable by manual pressing on a dispensing zone which is arranged in an access window of the case.

15. Unit for dispensing according to claim 14, characterised in that the dispensing zone has a flexibly deformable wall provided with a dispensing opening, the pumping chamber being formed between said wall and a reinforcement, said reinforcement having an opening for supplying the pumping chamber with product, with the dispensing and supplying openings being provided with a valve respectively for the output and the input which are arranged in order to allow, through deformation of the pumping chamber, the dispensing of the product by the dispensing opening and, via flexible return, the supply of the pumping chamber by the supply opening.

16. Unit for dispensing according to claim 15, characterised in that the reinforcement comprises the nipple that has a bore forming the supply opening.

* * * * *